US008471779B2

(12) United States Patent
Mosebrook

(10) Patent No.: US 8,471,779 B2
(45) Date of Patent: Jun. 25, 2013

(54) WIRELESS BATTERY-POWERED REMOTE CONTROL WITH LABEL SERVING AS ANTENNA ELEMENT

(75) Inventor: Donald R. Mosebrook, Coopersburg, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 343 days.

(21) Appl. No.: 12/781,458

(22) Filed: May 17, 2010

(65) Prior Publication Data

US 2011/0279300 A1 Nov. 17, 2011

(51) Int. Cl.
*H01Q 7/00* (2006.01)

(52) U.S. Cl.
USPC ..... 343/867; 341/179; 343/765; 343/766; 343/767; 343/866; 343/870

(58) Field of Classification Search
USPC ..... 341/179; 343/765, 766, 767, 866, 343/867, 870
See application file for complete search history.

(56) References Cited

U.S. PATENT DOCUMENTS

| | | | | |
|---|---|---|---|---|
| 4,864,588 | A | 9/1989 | Simpson et al. | |
| 4,932,037 | A | 6/1990 | Simpson et al. | |
| 4,995,053 | A | 2/1991 | Simpson et al. | |
| 5,239,205 | A | 8/1993 | Hoffman et al. | |
| 5,248,919 | A | 9/1993 | Hanna et al. | |
| 5,340,954 | A | 8/1994 | Hoffman et al. | |
| 5,736,965 | A | 4/1998 | Mosebrook et al. | |
| 5,818,128 | A | 10/1998 | Hoffman et al. | |
| 5,867,360 | A * | 2/1999 | Kishishita et al. | 361/292 |
| 5,905,442 | A | 5/1999 | Mosebrook et al. | |
| 5,982,103 | A | 11/1999 | Mosebrook et al. | |
| 6,225,951 | B1 * | 5/2001 | Holshouser et al. | 343/700 MS |
| 6,304,231 | B1 | 10/2001 | Reed et al. | |
| 6,906,669 | B2 * | 6/2005 | Sabet et al. | 343/700 MS |
| 6,977,615 | B2 * | 12/2005 | Brandwein, Jr. | 343/700 MS |
| 7,106,261 | B2 | 9/2006 | Nagel et al. | |
| 7,362,285 | B2 | 4/2008 | Webb et al. | |
| 7,408,525 | B2 | 8/2008 | Webb et al. | |
| 7,446,644 | B2 * | 11/2008 | Schaffzin et al. | 340/5.6 |
| 7,548,216 | B2 | 6/2009 | Webb et al. | |
| 7,573,436 | B2 * | 8/2009 | Webb et al. | 343/866 |
| 7,592,967 | B2 | 9/2009 | Mosebrook et al. | |
| 7,764,512 | B2 * | 7/2010 | Jow et al. | 361/799 |
| 2005/0280598 | A1 * | 12/2005 | Webb et al. | 343/867 |
| 2008/0036679 | A1 * | 2/2008 | Webb et al. | 343/867 |

(Continued)

OTHER PUBLICATIONS

U.S. Appl. No. 12/399,126, filed Mar. 6, 2009, entitled Battery Powered Remote Control Having Multiple Mounting Means.

(Continued)

*Primary Examiner* — Linh Nguyen
(74) *Attorney, Agent, or Firm* — Ostrolenk Faber LLP

(57) ABSTRACT

A remote control for a wireless control system includes a controller, at least one actuator for operating the controller, a radio-frequency (RF) transmitter coupled to the controller, an antenna coupled to the RF transmitter, and a housing for the controller, the RF transmitter, the antenna and a power source. The antenna comprises a conductive loop mounted in the housing and being disposed in a first plane. The remote control further comprises a surface on the housing disposed in a second plane substantially parallel to and overlying the first plane. The surface has a conductive material disposed thereon substantially coplanar with the second plane and substantially coextensive with said conductive loop on said first plane.

20 Claims, 13 Drawing Sheets

U.S. PATENT DOCUMENTS

| | | | | |
|---|---|---|---|---|
| 2008/0136736 | A1* | 6/2008 | Proctor et al. | 343/893 |
| 2009/0184652 | A1 | 7/2009 | Bollinger, Jr. et al. | |
| 2009/0251352 | A1 | 10/2009 | Altonen et al. | |
| 2009/0256484 | A1 | 10/2009 | Mosebrook et al. | |
| 2011/0095622 | A1* | 4/2011 | Feldstein et al. | 307/117 |
| 2011/0199265 | A1* | 8/2011 | Lin et al. | 343/700 MS |

OTHER PUBLICATIONS

U.S. Appl. No. 12/033,223, filed Feb. 19, 2008, entitled Communication Protocol for a Radio-Frequency Load Control System.

U.S. Appl. No. 11/559,166, filed Nov. 13, 2006, entitled Radio-Frequency Lighting Control System.

* cited by examiner

WIRELESS BATTERY-POWERED REMOTE CONTROL WITH LABEL SERVING AS ANTENNA ELEMENT

BACKGROUND OF THE INVENTION

1. Field of the Invention

The present invention relates to a wireless remote control and in particular to a wireless remote control for a wireless load control system for controlling the amount of power delivered to an electrical load from a source of alternating-current (AC) power. Even more particularly, the invention relates to a remote control for a radio-frequency (RF) lighting control system and its antenna.

2. Description of the Related Art

Control systems for controlling electrical loads, such as lights, motorized window treatments, and fans, are known. Such control systems often use radio-frequency (RF) transmission to provide wireless communication between the control devices of the system. One example of an RF lighting control system is disclosed in commonly-assigned U.S. Pat. No. 5,905,442, issued on May 18, 1999, entitled METHOD AND APPARATUS FOR CONTROLLING AND DETERMINING THE STATUS OF ELECTRICAL DEVICES FROM REMOTE LOCATIONS, the entire disclosure of which is hereby incorporated by reference.

The RF lighting control system of the '442 patent includes wall-mounted load control devices (e.g., dimmers), and a plurality of remote control devices (e.g., table-top and wall-mounted master controls), and car visor controls. The control devices of the RF lighting control system include RF antennas adapted to transmit and receive the RF communication signals that provide for communication between the control devices of the lighting control system. To prevent interference with other nearby RF lighting control systems located in close proximity, the control devices of the RF lighting control system stores in memory and uses an identical house code (i.e., a house address). Each of the control devices is also assigned a unique device address to allow for the transmission of the RF communication signals between specific control devices. The lighting control system also comprises signal repeaters, which help to ensure error-free communication by repeating the RF signals to ensure that every device of the system reliably receives the RF signals.

Each of the load control devices includes a user interface and an integral dimmer circuit for controlling the intensity of an attached lighting load. The user interface has a pushbutton actuator for providing on/off control of the attached lighting load and a raise/lower actuator for adjusting the intensity of the attached lighting load. The load control devices may be programmed with a preset lighting intensity that may be recalled later in response to an actuation of a button of the user interface or a received RF signal.

The table-top and wall-mounted master controls each have a plurality of buttons and are operable to transmit RF signals to the load control devices to control the intensities of the lighting loads. Each of the table-top and wall-mounted master controls may also comprise one or more visual indicators, e.g., light-emitting diodes (LEDs), for providing feedback to a user in response to a received RF signal. The car visor controls may be clipped to the visor of an automobile and include three buttons for respectively controlling the lighting loads to one of a maximum intensity, a minimum intensity (i.e., off), and a preset lighting level.

In addition, some lighting control systems may include portable hand-held RF remote controls. The remote control transmits RF energy to a load control device to control the operation of the load attached to the load control device. One requirement of such RF remote controls is that they must have a suitable omnidirectional antenna that provides good transmission characteristics. The remote control embodiment described in the prior application is a transmit only device, but it is a requirement for all such RF remote control devices, whether transmit only or having transmit and receive capabilities, that they have a reliable antenna, particularly one whose propagation and/or reception characteristics are not unduly impacted by the user's hands. Therefore, there is a need for such a remote control device that has a reliable, high performance antenna operating at RF frequencies.

SUMMARY OF THE INVENTION

According to an embodiment of the present invention, a remote control for a wireless control system is provided. The remote control comprises a controller, at least one actuator for operating the controller, a radio-frequency transmitter coupled to the controller, an antenna coupled to the radio-frequency transmitter, a housing for the controller, the radio-frequency transmitter, the antenna and a power source. The antenna comprises a conductive loop that is mounted in the housing and is disposed in a first plane. The remote control further comprises a surface on the housing disposed in a second plane substantially parallel to and overlying the first plane. The surface has a conductive material disposed thereon substantially coplanar with the second plane and substantially coextensive with said conductive loop on said first plane.

Other features and advantages of the present invention will become apparent from the following description of the invention that refers to the accompanying drawings.

DETAILED DESCRIPTION OF THE INVENTION

Figure 1:
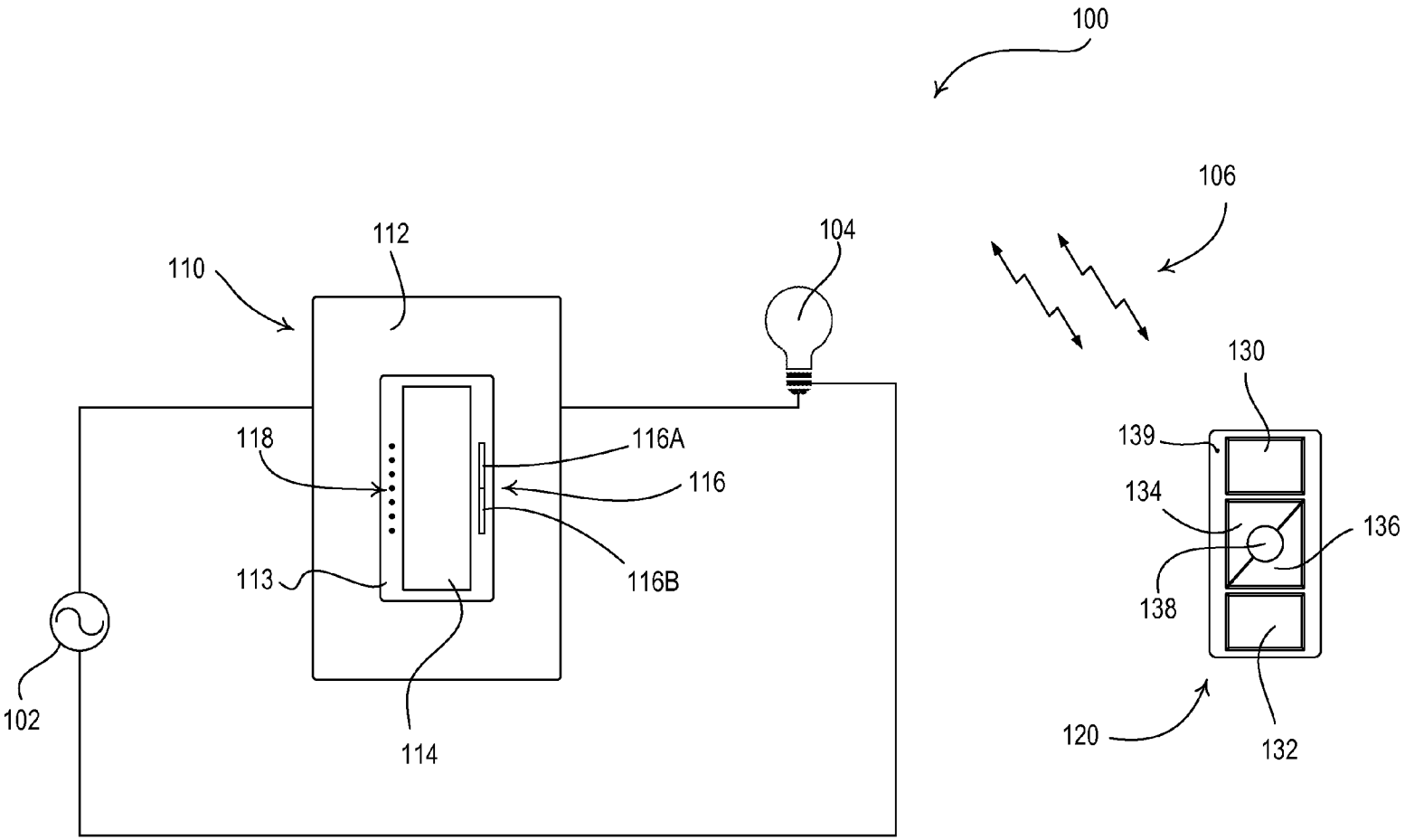
FIG. 1 is a simplified diagram of an RF lighting control system comprising a dimmer switch and a remote control.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

FIG. 1 is a simplified diagram of an RF load control system 100 comprising a remotely-controllable load control device (e.g., a dimmer switch 110) and a remote control 120. The dimmer switch 110 is adapted to be wall-mounted in a standard electrical wallbox. The dimmer switch 110 is coupled in series electrical connection between an AC power source 102 and an electrical lighting load 104 for controlling the amount of power delivered to the lighting load. The dimmer switch 110 comprises a faceplate 112 and a bezel 113 received in an opening of the faceplate. Alternatively, the RF lighting control system 100 may comprise another type of remotely-controllable load control device, for example, a remotely-controllable electronic dimming ballast, a motor control device, or a motorized window treatment, such as, a roller shade or a drapery.

The dimmer switch 110 comprises a toggle actuator 114 (i.e., a control button) and an intensity adjustment actuator 116 (e.g., a rocker switch). Actuations of the toggle actuator 114 toggle, i.e., alternately turn off and on, the lighting load 104. The dimmer switch 110 may be programmed with a lighting preset intensity (i.e., a "favorite" intensity level), such that the dimmer switch is operable to control the intensity of the lighting load 104 to the preset intensity when the lighting load is turned on by an actuation of the toggle actuator 114. Actuations of an upper portion 116A or a lower portion 116B of the intensity adjustment actuator 116 respectively increase or decrease the amount of power delivered to the lighting load 104 and thus increase or decrease the intensity of the lighting load 104.

A plurality of visual indicators 118, e.g., light-emitting diodes (LEDs), are arranged in a linear array on the left-side of the bezel 113. The visual indicators 118 are illuminated to provide feedback of the present intensity of the lighting load 104. The dimmer switch 110 illuminates one of the plurality of visual indicators 118, which is representative of the present light intensity of the lighting load 104. An example of a dimmer switch having a toggle actuator 114 and an intensity adjustment actuator 116 is described in greater detail in U.S. Pat. No. 5,248,919, issued Sep. 29, 1993, entitled LIGHTING CONTROL DEVICE, the entire disclosure of which is hereby incorporated by reference.

Figure 2A:
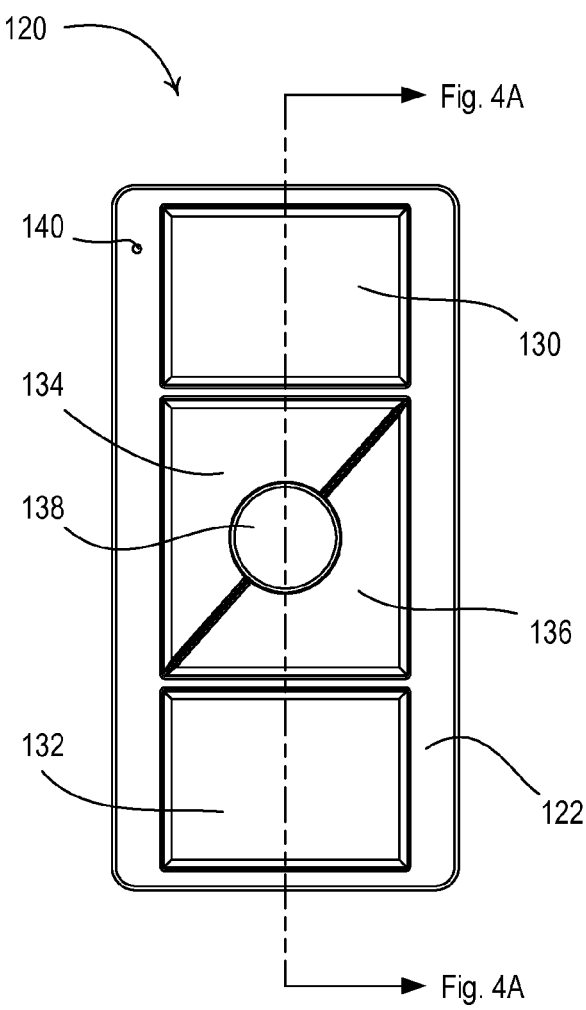
FIG. 2A is a front view of the remote control of the lighting control system of FIG. 1.
Figure 2B:
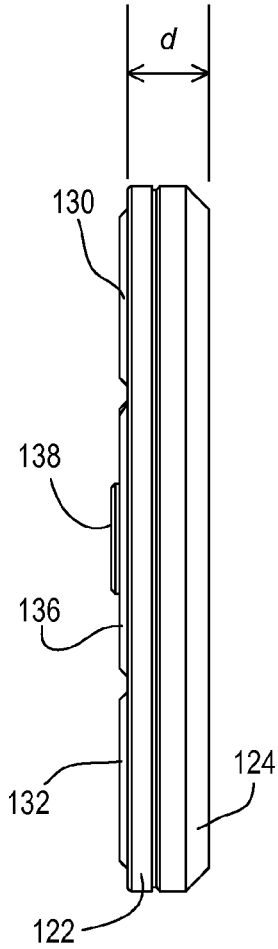
FIG. 2B is a right-side view of the remote control of the lighting control system of FIG. 1.

FIG. 2A is an enlarged front view and FIG. 2B is a right-side view of the remote control 120. The remote control 120 comprises a housing that includes a front enclosure portion 122 and a rear enclosure portion 124. The remote control 120 further comprises a plurality of actuators (i.e., an on button 130, an off button 132, a raise button 134, a lower button 136, and a preset button 138). The remote control 120 also comprises a visual indicator 140, which is illuminated in response to the actuation of one of the buttons 130-138. The remote control 120 transmits packets (i.e., messages) via RF signals 106 (i.e., wireless transmissions) to the dimmer switch 110 in response to actuations of any of the actuators. A packet transmitted by the remote control 120 includes, for example, a preamble, a unique device identifier (e.g., a serial number) associated with the remote control, and a command (e.g., on, off, or preset), and comprises 72 bits. In order to meet the standards set by the FCC, packets are transmitted such that there is not less than a predetermined time period between two consecutive packets, for example, approximately 100 msec.

During a setup procedure of the RF load control system 100, the dimmer switch 110 is associated with one or more remote controls 120. The dimmer switch 110 is then responsive to packets containing the unique device identifier of the remote control 120 to which the dimmer switch is associated. The dimmer switch 110 is operable to turn on and to turn off the lighting load 104 in response to an actuation of the on button 130 and the off button 132, respectively. The dimmer switch 110 is operable to control the lighting load 104 to the preset intensity in response to an actuation of the preset button 138. The dimmer switch 110 may be associated with the remote control 120 during a manufacturing process of the dimmer switch and the remote control, or after installation of the dimmer switch and the remote control.

Figure 3:
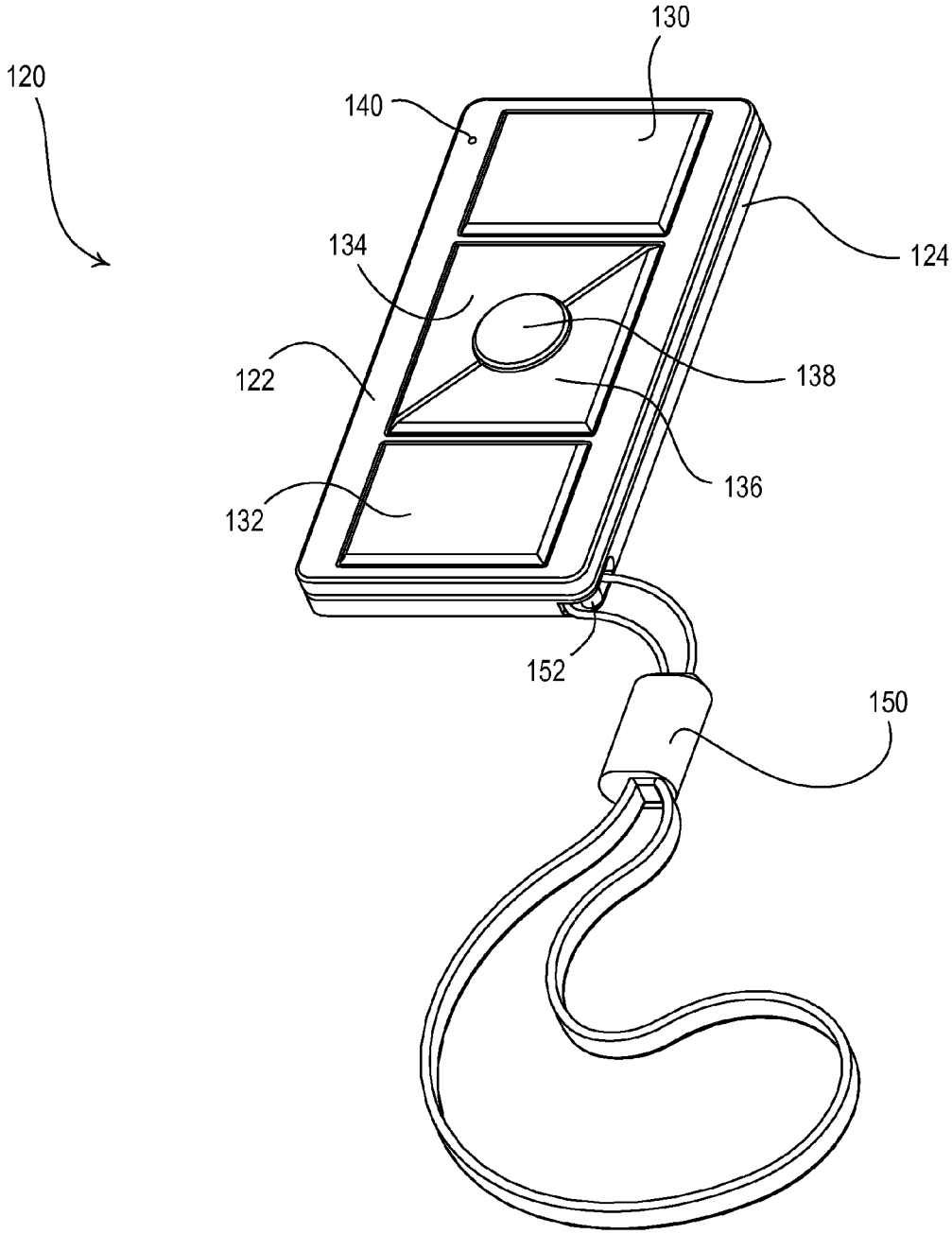
FIG. 3 is a perspective view of the remote control of FIG. 1 including a lanyard.
Figure 4:
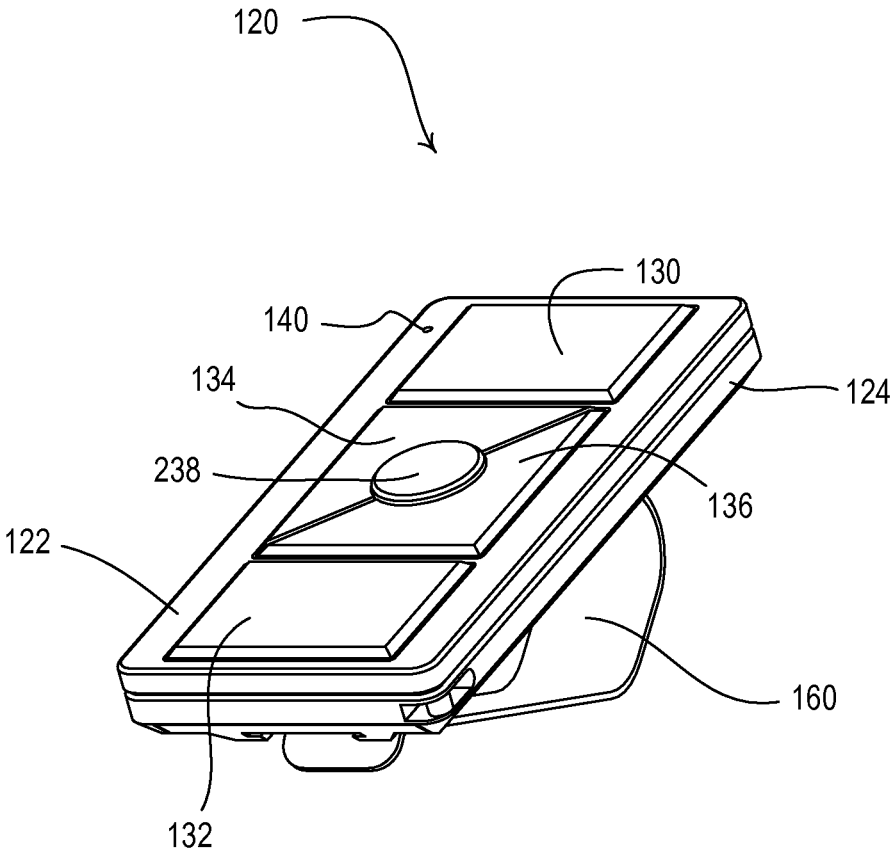
FIG. 4 is a perspective view of the remote control of FIG. 1 including a clip.
Figure 5:
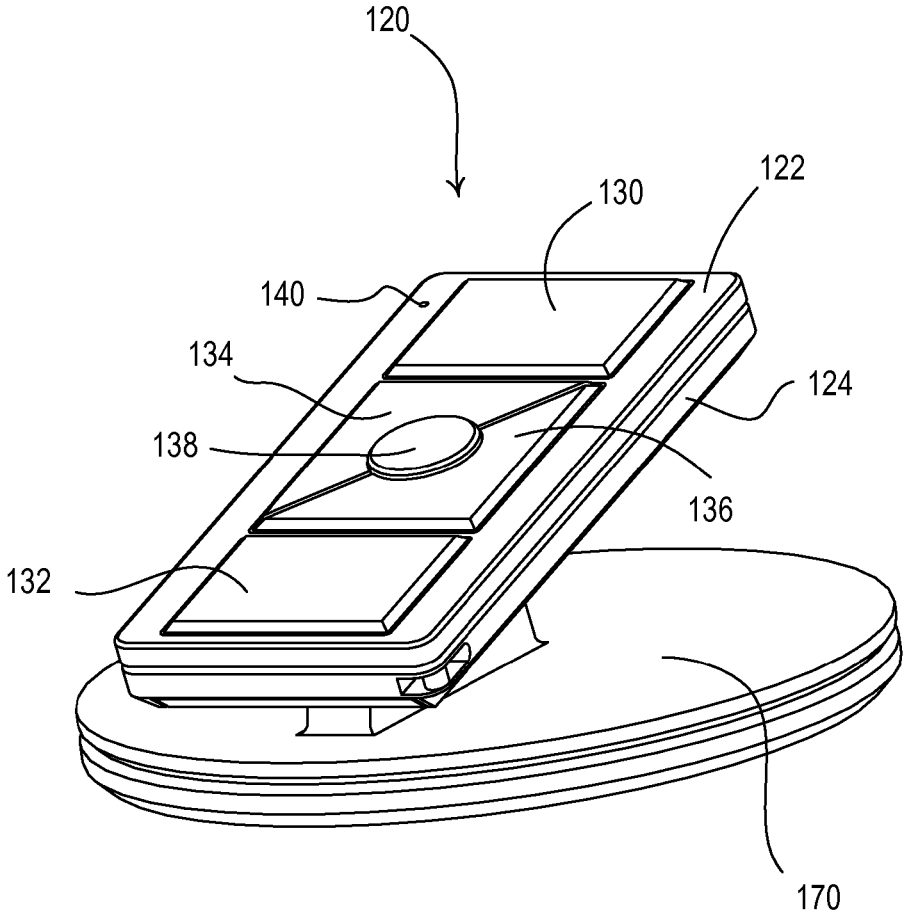
FIG. 5 is a perspective view of the remote control of FIG. 1 mounted to a base portion for supporting the remote control on a horizontal surface.
Figure 6:
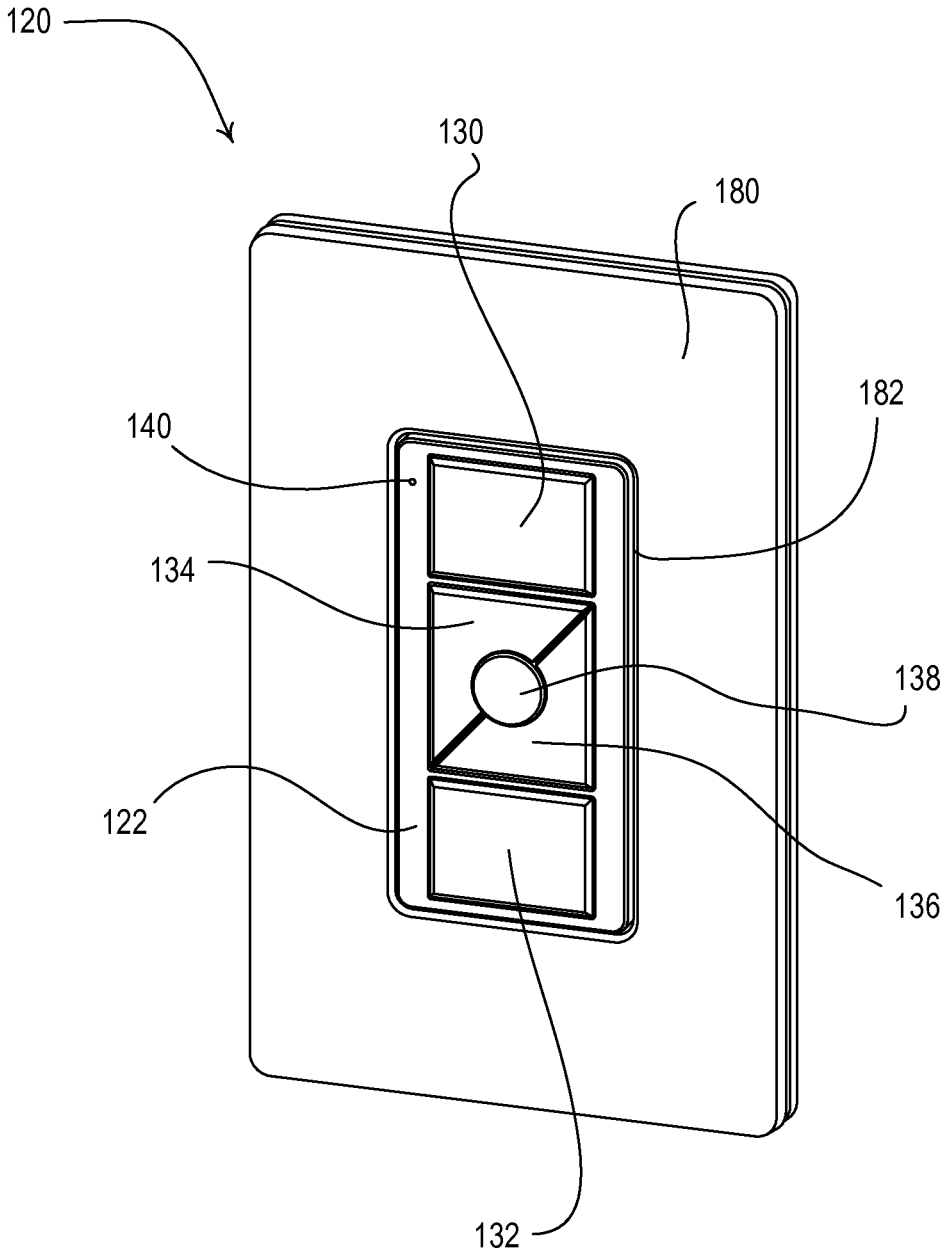
FIG. 6 is a perspective view of the remote control of FIG. 1 mounted to a vertical surface inside an opening of a standard-sized faceplate.

The remote control 120 is adapted to provide multiple mounting means. First, the remote control 120 may be used as a hand-held device, and may have a lanyard 150 (or other type of cord) connected to an attachment post 152 as shown in FIG. 3. Also, the remote control 120 is adapted to be connected to a clip 160 as shown in FIG. 4, such that the remote control may be clipped to, for example, a sun visor of an automobile. Further, the remote control 120 may be connected to a base portion 170 as shown in FIG. 5 to allow the remote control to rest on a substantially flat horizontal surface, such as, a tabletop. Finally, the remote control 120 may be mounted on a substantially flat vertical surface (such as, a wall) as shown in FIG. 6, such that the remote control 120 may be received in an opening 182 of a faceplate 180. The multiple mounting means of the remote control 120 are described in greater detail in commonly-assigned U.S. patent application Ser. No. 12/399,126, filed Mar. 6, 2009, entitled BATTERY POWERED REMOTE CONTROL HAVING MULTIPLE MOUNTING MEANS, the entire disclosure of which is hereby incorporated by reference.

Figure 7:
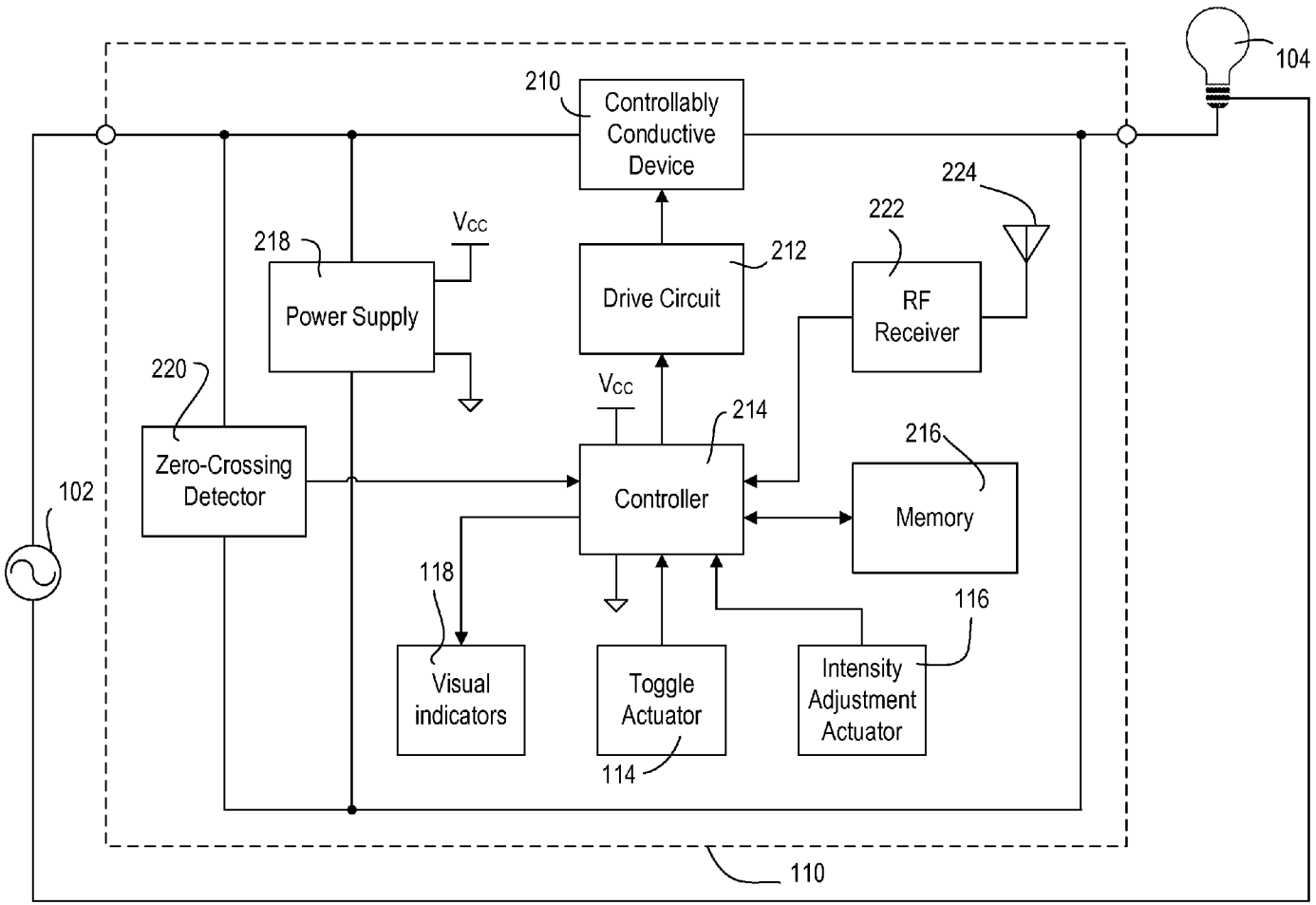
FIG. 7 is a simplified block diagram of the dimmer switch of the lighting control system of FIG. 1.

FIG. 7 is a simplified block diagram of the dimmer switch 110. The dimmer switch 110 comprises a controllably conductive device 210 coupled in series electrical connection between the AC power source 102 and the lighting load 104 for control of the power delivered to the lighting load. The controllably conductive device 210 may comprise any suitable type of bidirectional semiconductor switch, such as, for example, a triac, a field-effect transistor (FET) in a rectifier bridge, or two FETs in anti-series connection. The controllably conductive device 210 includes a control input coupled to a drive circuit 212. The input provided to the control input will render the controllably conductive device 210 conductive or non-conductive, which in turn controls the power supplied to the lighting load 204.

The drive circuit 212 provides control inputs to the controllably conductive device 210 in response to command signals from a controller 214. The controller 214 may be implemented as a microcontroller, a microprocessor, a programmable logic device (PLD), an application specific integrated circuit (ASIC), a field-programmable gate array (FPGA), or any suitable processing device. The controller 214 receives inputs from the toggle actuator 114 and the intensity adjustment actuator 116 and controls the visual indicators 118. The controller 214 is also coupled to a memory 216 for storage of the preset intensity of lighting load 104 and the unique device identifier of the remote control 120 to which the dimmer switch 110 is associated. A power supply 218 generates a direct-current (DC) voltage $V_{CC}$ for powering the controller 214, the memory 216, and other low-voltage circuitry of the dimmer switch 110.

A zero-crossing detector 220 determines the zero-crossings of the input AC waveform from the AC power supply 102. A zero-crossing is defined as the time at which the AC supply voltage transitions from positive to negative polarity, or from negative to positive polarity, at the beginning of each half-cycle. The controller 214 provides the control inputs to the drive circuit 212 to operate the controllably conductive device 210 (i.e., to provide voltage from the AC power supply 102 to the lighting load 104) at predetermined times relative to the zero-crossing points of the AC waveform.

The dimmer switch 110 further comprises an RF receiver 222 and an antenna 224 for receiving the RF signals 106 from the remote control 120. The controller 214 is operable to control the controllably conductive device 210 in response to the packets received via the RF signals 106. Examples of the antenna 224 for wall-mounted dimmer switches, such as the dimmer switch 110, are described in greater detail in U.S. Pat. No. 5,982,103, issued Nov. 9, 1999, and U.S. Pat. No. 7,362,285, issued Apr. 22, 2008, both entitled COMPACT RADIO FREQUENCY TRANSMITTING AND RECEIVING ANTENNA AND CONTROL DEVICE EMPLOYING SAME, the entire disclosures of which are hereby incorporated by reference.

Figure 8:
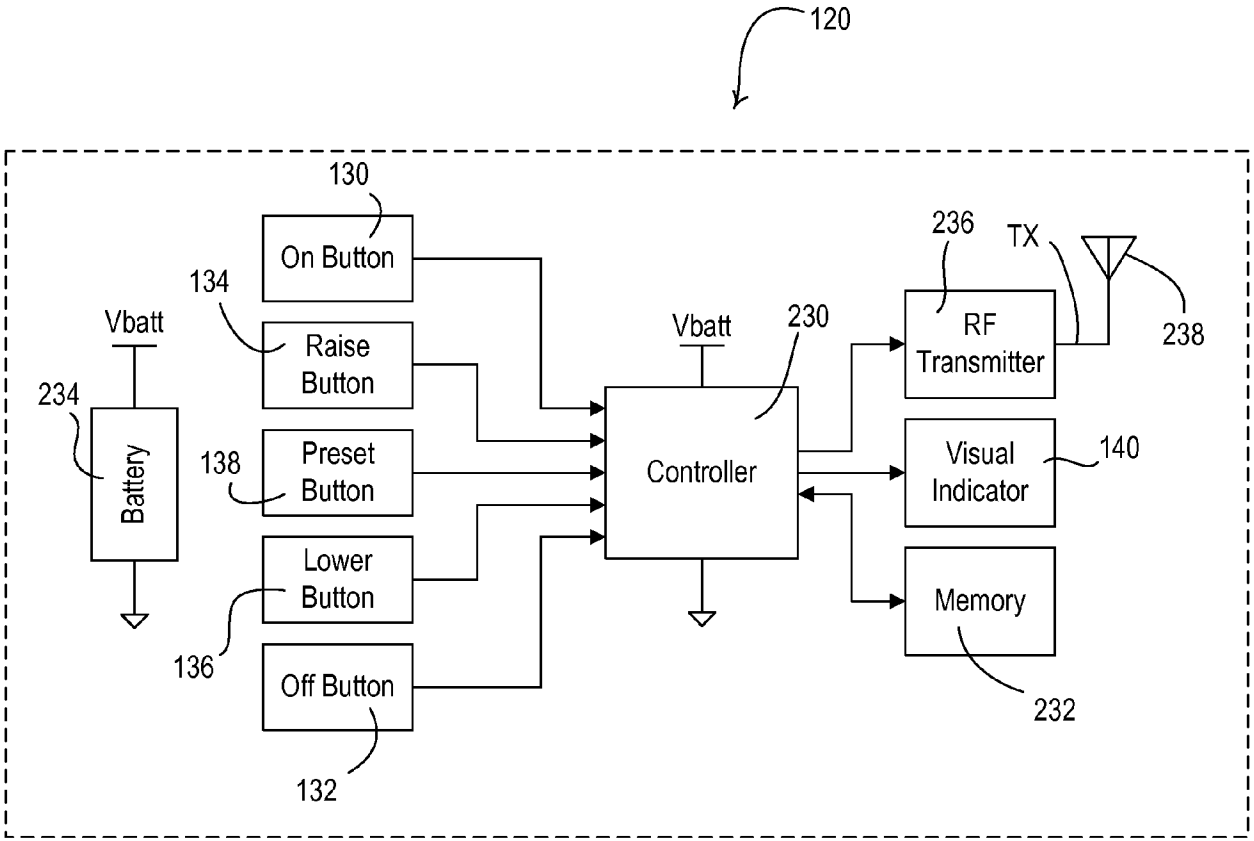
FIG. 8 is a simplified block diagram of the remote control of the lighting control system of FIG. 1.

FIG. 8 is a simplified block diagram of the remote control 120. The remote control 120 comprises a controller 230, which is operable to receive inputs from the buttons 130-138 and to control the visual indicator 140. The remote control 120 comprises a memory 232 for storage of the unique device identifier (e.g., a serial number) of the remote control. For example, the unique device identifier comprises a seven-byte number that is programmed into the memory 232 during manufacture of the remote control 120. Two series-coupled batteries 234A, 234B provide a DC voltage $V_{BATT}$ (e.g., 6V) for powering the controller 230, the memory 232, and other low-voltage circuitry of the remote control 120. For example, each of the batteries 234A, 234B may comprise a 3-V lithium coin battery, such as, part number CR2016 manufactured by Energizer. Alternatively, the remote control 120 could comprise, for example, only one 3-V lithium coin battery, such as, part number CR2032 manufactured by Energizer.

The remote control 120 further includes an RF transmitter 236 coupled to the controller 230 and an antenna 238, which may comprise, for example, a loop antenna. In accordance with the present invention, the antenna 238 comprises a loop antenna that is constructed as a loop disposed on a printed circuit board and in particular, as will be explained in detail below, of four major components, including two printed circuit board loops on either side of a printed circuit board comprising the electronic circuit for the remote control device, a conductive plate disposed adjacent the loop and a capacitive circuit disposed in series with the loop.

In response to an actuation of one of the on button 130, the off button 132, the raise button 134, the lower button 136, and the preset button 138, the controller 230 causes the RF transmitter 236 to transmit a packet to the dimmer switch 110 via the RF signals 106. The RF transmitter 236 generates a transmit signal TX, which is coupled to the antenna 238 for causing the antenna to transmit the RF signals 106. Alternatively, the RF receiver 222 of the dimmer switch 110 and the RF transmitter of the remote control 120 could both comprise RF transceivers to allow for two-way RF communication between the remote control and the dimmer switch. An example of a two-way RF lighting control systems is described in greater detail in co-pending, commonly-assigned U.S. patent application Ser. No. 12/033,223, filed Feb. 19, 2008, entitled COMMUNICATION PROTOCOL FOR A RADIO-FREQUENCY LOAD CONTROL SYSTEM, the entire disclosure of which is hereby incorporated by reference.

The lighting control system 100 provides a simple one-step configuration procedure for associating the remote control 120 with the dimmer switch 110. A user simultaneously presses and holds the on button 130 on the remote control 120 and the toggle button 114 on the dimmer switch 110 to link the remote control 120 and the dimmer switch 110. The user may simultaneously press and hold the off button 132 on the remote control 120 and the toggle button 114 on the dimmer switch 110 to unassociate the remote control 120 with the dimmer switch 110. The configuration procedure for associating the remote control 120 with the dimmer switch 110 is described in greater detail in co-pending commonly-assigned U.S. patent application Ser. No. 11/559,166, filed Nov. 13, 2006, entitled RADIO-FREQUENCY LIGHTING CONTROL SYSTEM, the entire disclosure of which is hereby incorporated by reference.

Figure 9:
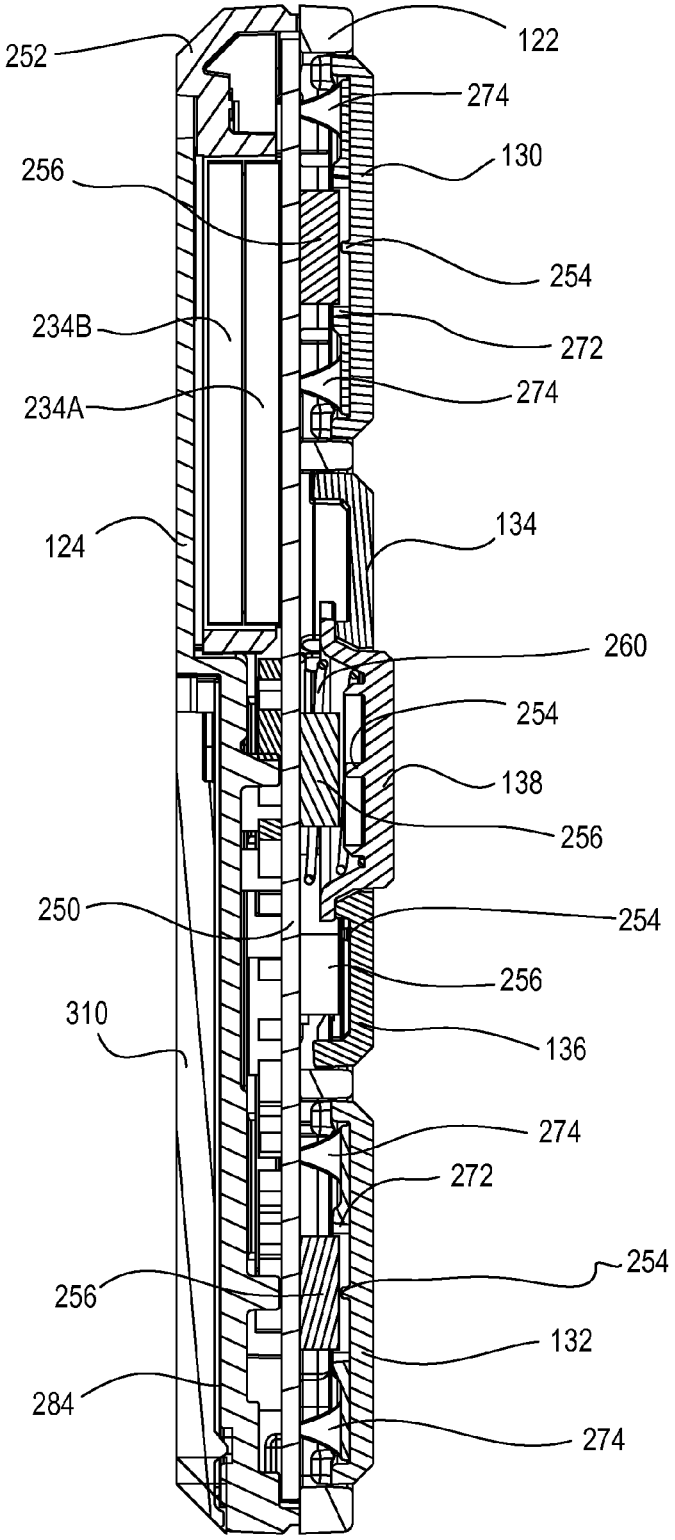
FIG. 9 is a left-side cross-sectional view of the remote control of FIG. 1 taken through the center of the remote control.
Figure 12:
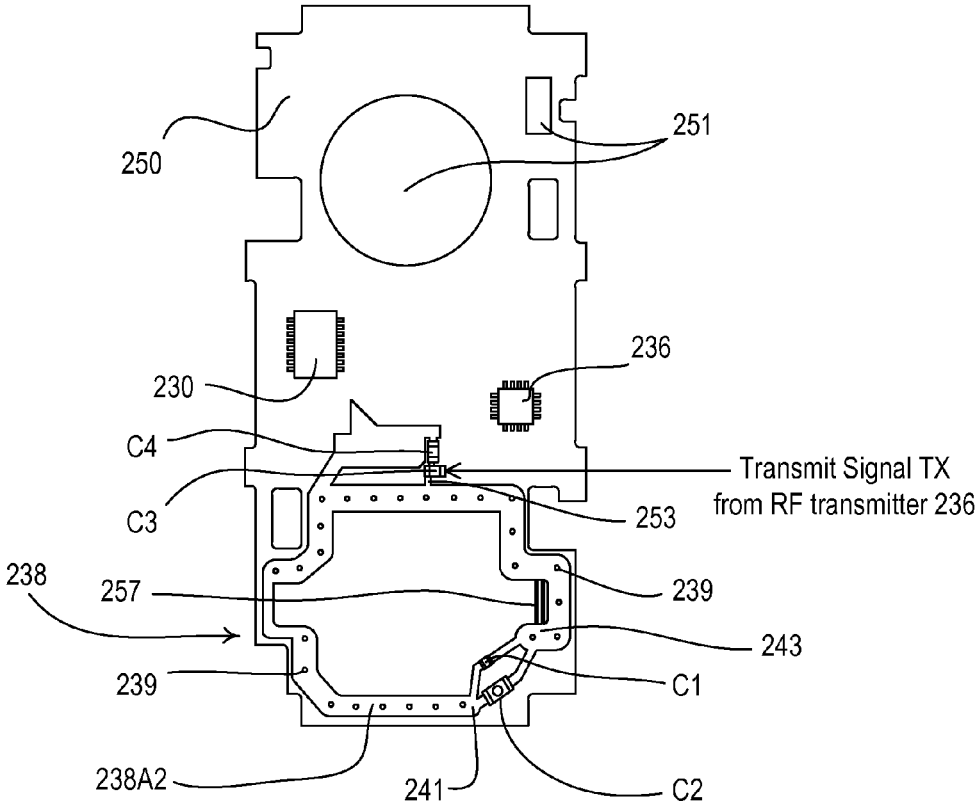
FIG. 12 is a rear view of the printed circuit board of the remote control of FIG. 11.

FIG. 9 is a left-side cross-sectional view of the remote control 120 taken through the center of the remote control as shown in FIG. 2A. The electrical circuitry of the remote control 120 (as shown in FIG. 8) is mounted to a printed circuit board (PCB) 250, which is housed between the front enclosure portion 122 and the rear enclosure portion 124. The batteries 234A, 234B are located in a battery enclosure portion 252 and are electrically coupled to the circuitry on the PCB 250 via electrical contacts 251 (FIG. 12). The battery enclosure portion 252 may be slidably received in the rear enclosure portion 124, such that the battery enclosure portion may be pulled away from the rear enclosure portion 124 to allow for replacement of the batteries 234A, 234B.

Figure 11:
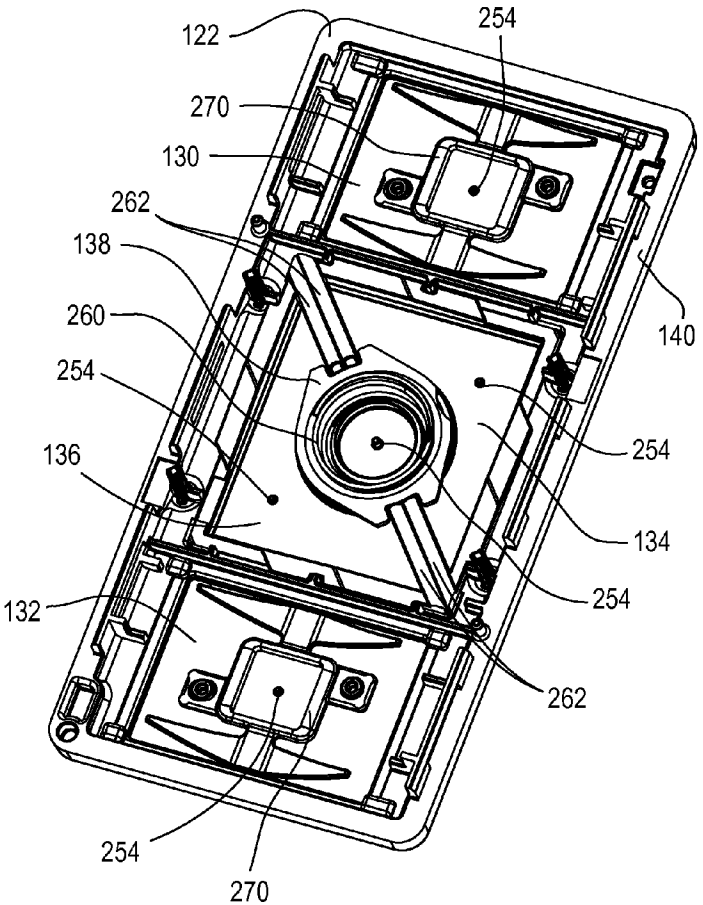
FIG. 11 is a rear perspective view of a front enclosure portion and a plurality of buttons of the remote control of FIG. 1.
Figure 10:
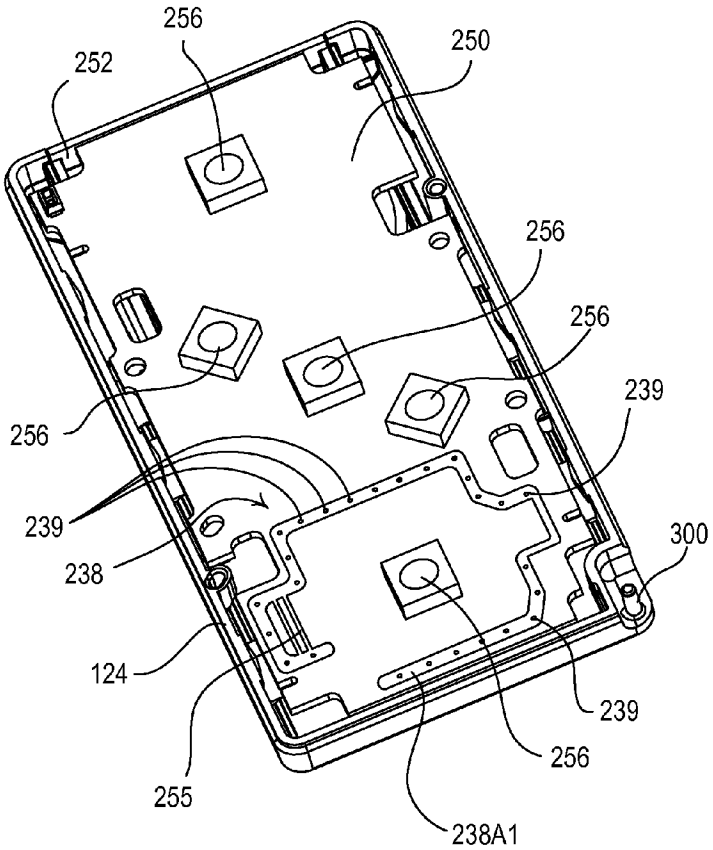
FIG. 10 is a front perspective view of a rear enclosure portion and a printed circuit board of the remote control of FIG. 1.

FIGS. 10 and 11 show the remote control 120 in a partially-disassembled state. Specifically, FIG. 10 is a front perspective view of the rear enclosure portion 124 and the PCB 250, and FIG. 11 is a rear perspective view of the front enclosure portion 122 and the buttons 130-138. The on button 130, the off button 132, the raise button 134, the lower button 136, and preset button 138 comprise actuation posts 254 for actuating mechanical tactile switches 256 mounted on the PCB 250. The remote control 120 comprises a coil spring 260, which is positioned between the preset button 138 and the PCB 250. The coil spring 260 operates to return the preset button 138 to an idle position after the button is actuated. The raise button 134 and the lower button 136 comprise edges 262 that rest on the PCB 250. The raise and lower buttons 134, 136 are operable to pivot about the edges 262 when the buttons are actuated. The remote control 120 further comprises return springs 270 (FIG. 11) connected to the bottom sides of the on button 130 and the off button 132.

FIGS. 10 and 12 show details of the antenna 238. Only those components that are important to the disclosure of the present invention are shown on the PCB 250 in FIGS. 10 and 12. The antenna 238 preferably comprises two loop elements 238A1, 238A2 that are disposed on separate sides of the PCB 250 and are electrically in parallel. Specifically, the first loop element 238A1 is disposed on a first side of the PCB 250 as shown in FIG. 10, and the second loop element 238A2 is disposed on a second side as shown in FIG. 4D. The two loop elements are disposed so that they overlie each other.

Figure 13:
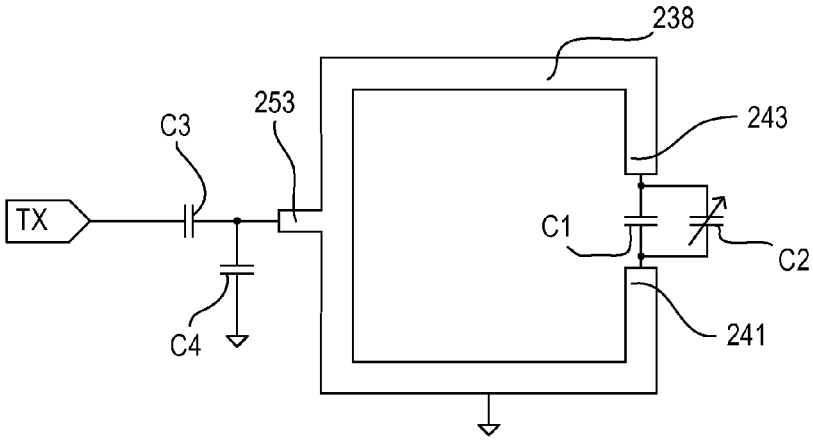
FIG. 13 shows a schematic representation of an antenna of the remote control of FIG. 1.

The first loop element 238A1 is connected in parallel to the second loop element 238A2 by a series of vias 239. As shown in FIG. 12, a capacitive circuit is provided in series with the loop to provide an L-C resonant circuit. The capacitive circuit includes a capacitor C1 coupled in parallel with a variable capacitor C2. The parallel combination of the capacitor C1 and the variable capacitor C2 is provided between ends 241 and 243 of the second loop element 238A2. The variable capacitor C2 provides for antenna tuning, or trimming. Additional capacitive elements 255, 257 may be provided on the PCB 250 across a portion of the first and second loop elements 238A1, 238A2, respectively. The antenna 238 receives the signal to transmit from the RF transmitter 236 via a capacitor C3 and an antenna feed connection 253. The junction of capacitor C3 and the antenna feed connection 253 is coupled to circuit common via a capacitor C4. FIG. 13 is a schematic representation of the antenna 238.

Alternatively, the antenna 238 could only comprise a single loop element. In addition, the antenna 238 could alternatively comprise another type of loop antenna, such as, for example, a resonant loop antenna or a tapped loop antenna. Examples of alternative types of antennas are described in greater detail in commonly-assigned U.S. Pat. No. 7,573,436, issued Aug. 11, 2009, entitled COMPACT RADIO FREQUENCY TRANSMITTING AND RECEIVING ANTENNA AND CONTROL DEVICE EMPLOYING SAME, and U.S. Pat. No. 7,592,967, issued Sep. 22, 2009, entitled COMPACT ANTENNA FOR A LOAD CONTROL DEVICE, the entire disclosures of which are hereby incorporated by reference.

Figure 14:
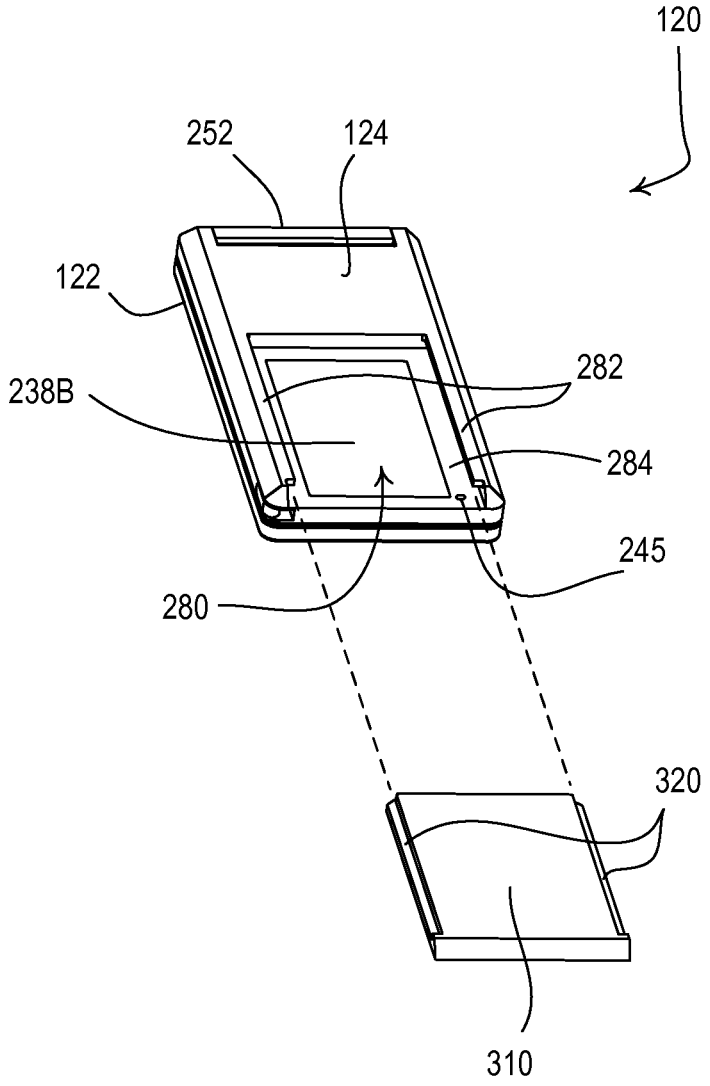
FIG. 14 is a rear perspective view of the remote control of FIG. 1 showing further details of the antenna including a metallic plate that also functions as a label.

FIG. 14 is a rear perspective view of the remote control 120. As shown in FIG. 14, the rear enclosure portion 124 of the remote control 120 comprises a slide-receiving portion 280, which includes two parallel flanges 282. The slide-receiving portion 280 of the rear enclosure portion 124 may receive a blank plate 310, which includes two parallel slide rails 320 on opposite sides of the plate. The flanges 282 of the slide-receiving potion 280 receive the slide rails 320 to hold the blank plate 310 to the rear enclosure portion 124. The blank plate 310 provides an aesthetic feature by allowing the outer surface of the remote control 120 to have a continuous appearance. The slide-receiving portion 280 also enables the remote control 120 to be coupled to the different mounting structures, i.e., the clip 160, the table-top base portion 170, and a mounting plate (not shown) for mounting the remote control to a wall as shown in FIGS. 4-6.

As shown in FIG. 14, a conductive plate, e.g., a metallic label 238B is provided on the exterior of the remote control 120, preferably on a flat surface 284 in the slide-receiving portion 280 of the rear enclosure portion 124 of the remote control. The metallic label 238B physically overlies the first and second loop elements 238A1, 238A2 of the antenna 238 on the PCB 250. For example, the metallic label 238B may be made from aluminum (or any suitable metallic element) and may be laminated with a plastic layer. Together, the loop elements 238A1, 238A2, the capacitive circuit, and the metallic label 238B form an L-C circuit that may be tuned to resonate at a desired frequency. The antenna 238 is tuned after the metal label 238B is applied to the rear enclosure portion 124 of the housing of the remote control 120. To this end, the rear enclosure portion 124 includes a small opening 245 (FIG. 14) disposed over the trimming element of variable capacitor C2 that allows a suitable tool, i.e., a trimming driver, to be inserted to adjust the movable adjustment member of variable capacitor C2. The blank plate 310 (or other mounting structure) covers the metallic label 238B and the opening 245 when the plate is fully received in the slide-receiving portion 280.

As described above, the remote control 120 of the present invention may be mounted using the various mounting means shown in FIGS. 3-6 (e.g., hand held, clipped to a sun visor of an automobile, placed on a tabletop, or mounted to a wall), which can result in changes the impedance, and thus the range and reliability, of the antenna 238. According to the present invention, the metal label 238B functions to stabilize the impedance of the antenna 238 when used with the various mounting means, to thus provide consistent performance of the antenna in all installations.

Figure 15:
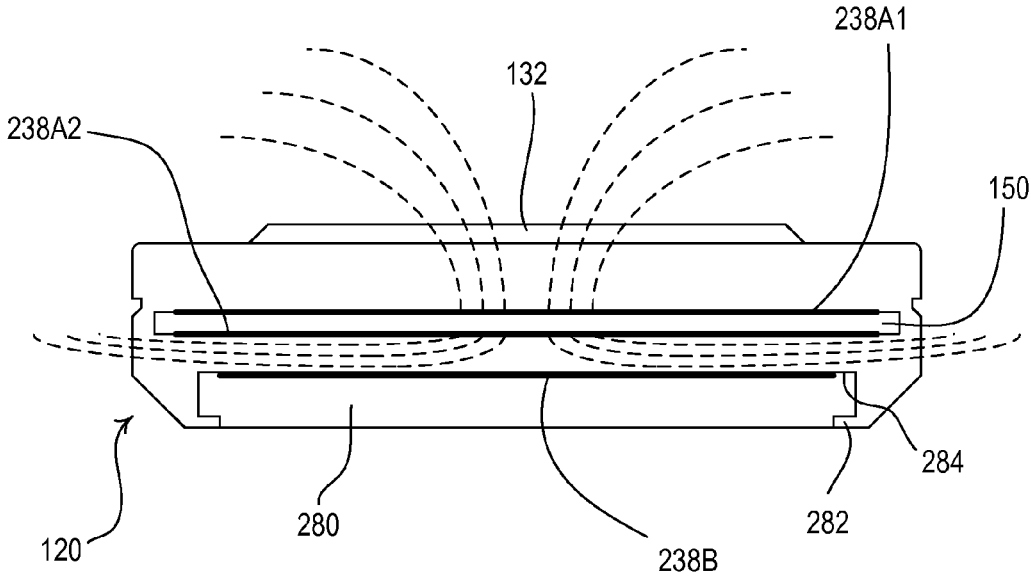
FIG. 15 is a bottom view of the remote control of FIG. 1 illustrating the magnetic field lines of the antenna.

FIG. 15 is a bottom view of the remote control 120 illustrating the magnetic field lines of the antenna 238 (shown as dashed lines), which are generated when the remote control is transmitting the RF signals 106. FIG. 15 also illustrates the orientation of the first and second loop elements 238A1, 238A2 (on the PCB 250) and the metallic label 238B (on the flat surface 284 in the slide-receiving portion 280). The magnetic field lines extend through the front enclosure portion 122 and the off button 132 of the remote control 120. The metallic label 238B is preferably approximately coextensive with the loop elements 238A1, 238A2, and operates as a shield, such that the magnetic field lines travel between the PCB 250 and the metallic label 238B, and out the sides of the remote control 120. Accordingly, the metallic label 238B substantially shields the first and second loop elements 238A1, 238A2 from the various objects that may be coupled to the rear enclosure portion 124 of the remote control 120 (e.g., a user's hand, the clip 160, the base portion 170, or a wall), such that the various mounting means do not greatly alter the magnetic field lines, and thus the tuned frequency of the antenna 238. Therefore, the metallic label 238B provides for more consistent antenna performance, even when metallic objects (such as the clip 160) are present behind the metallic label 238B (i.e., coupled to the slide-receiving portion 280).

In addition, the metallic label 238B serves a dual purpose. The metallic label 238B can also function as a manufacturer's label for the remote control 120, bearing such data as the identity of the manufacturer/seller, technical data regarding the device and its power source, operating frequency, FCC data and other information, such as a technical support phone number, etc.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A remote control for a wireless control system, the remote control comprising:

a controller;

at least one actuator for operating said controller;

a radio-frequency transmitter coupled to said controller;

an antenna coupled to said radio-frequency transmitter;

a housing for said controller, said radio-frequency transmitter, said antenna and a power source;

said antenna comprising a conductive loop mounted in said housing and being disposed in a first plane, further comprising a surface on said housing disposed in a second plane substantially parallel to and overlying said first plane, said surface having a conductive material disposed thereon substantially coplanar with said second plane and substantially coextensive with said conductive loop on said first plane and electrically isolated from said conductive loop and functioning as a part of said antenna;

further wherein said conductive material comprises a label with identifying indicia for said remote control, said surface comprising an exterior surface of said housing whereby the identifying indicia is visible to a user of the remote control.

2. The remote control of claim 1, wherein said conductive loop is disposed on a printed circuit board.

3. The remote control of claim 2, wherein circuitry for said controller, said radio frequency transmitter, and said conductive loop is mounted on said printed circuit board.

4. The remote control of claim 3, wherein said loop comprises first and second parallel connected loops disposed on opposite sides of said printed circuit board.

5. The remote control of claim 4, wherein said loops are parallel connected by at least one via through said printed circuit board.

6. The remote control of claim 2, wherein said loop has ends that are coupled together by a capacitive circuit.

7. The remote control of claim 6, wherein said capacitive circuit includes a variable capacitor for tuning the resonant frequency of said antenna.

8. The remote control of claim 7, further comprising an opening in said housing disposed over said variable capacitor for providing access for a tool to adjust said variable capacitor.

9. The remote control of claim 1, wherein said conductive material comprises a plate comprising a metallic material.

10. The remote control of claim 9, wherein said conductive material comprises a laminated structure comprising a metallic plate and an insulating material.

11. The remote control of claim 9, wherein the metallic material is aluminum.

12. The remote control of claim 9, wherein said label bears printed informative matter.

13. The remote control of claim 9, wherein said plate is disposed in a recess in said housing, the recess serving to allow attachment of an external device to said remote control.

14. The remote control of claim 13, wherein said recess has channels that slidably receive said external device, said external device comprising a mounting device for said remote control.

15. The remote control of claim 13, wherein said external device comprises a blank plate that provides an aesthetic feature by allowing the outer surface of the remote control to have a continuous appearance.

16. The remote control of claim 1, wherein the housing comprises a slide-receiving portion adapted to receive a plurality of mounting structures, said surface and said conductive material provided in said slide-receiving portion.

17. The remote control of claim 16, wherein the plate is adapted to be fastened to a substantially flat vertical surface to mount the remote control to the surface, the slide-receiving portion further adapted to be coupled to a clip, the slide-receiving portion further adapted to be coupled to a base portion for resting the remote control on a substantially flat horizontal surface.

18. The remote control of claim 17, wherein the conductive material operates to stabilize the impedance of the antenna when mounted with the plurality of mounting structures.

19. The remote control of claim 16, further comprising:

a plate having two parallel slide rails extending along opposite sides of the plate;

wherein the slide-receiving portion of the housing comprises two parallel flanges arranged to slidingly receive the slide rails of the plate, said plate covering said conductive material when said plate is fully received in said slide-receiving portion.

20. The remote control of claim 1, wherein the at least one actuator includes an on/off button and an up/down button for use with an RF lighting control system.

* * * * *